US008209869B2

(12) United States Patent
Royle

(10) Patent No.: US 8,209,869 B2
(45) Date of Patent: Jul. 3, 2012

(54) CANTILEVER COMB GUARD

(75) Inventor: Terence Gordon Royle, Basingstoke (GB)

(73) Assignee: The Gillette Company, Boston, MA (US)

( * ) Notice: Subject to any disclaimer, the term of this patent is extended or adjusted under 35 U.S.C. 154(b) by 310 days.

(21) Appl. No.: 12/614,600

(22) Filed: Nov. 9, 2009

(65) Prior Publication Data

US 2011/0107600 A1 May 12, 2011

(51) Int. Cl.
*B26B 21/00* (2006.01)
*B26B 21/40* (2006.01)

(52) U.S. Cl. ..... 30/50; 30/74.1; 30/77

(58) Field of Classification Search ..... 30/47, 49, 30/50, 54, 55, 59–61, 63, 65, 70, 74.1, 77–83
See application file for complete search history.

(56) References Cited

U.S. PATENT DOCUMENTS

| | | | | | |
|---|---|---|---|---|---|
| 1,935,452 | A | * | 11/1933 | Kondolf | 30/77 |
| 3,138,865 | A | * | 6/1964 | Meyer | 30/82 |
| 3,165,831 | A | * | 1/1965 | Carroll | 30/50 |
| 3,183,589 | A | * | 5/1965 | Szabo | 30/30 |
| 3,735,486 | A | * | 5/1973 | Risher | 30/78 |
| 3,797,110 | A | * | 3/1974 | Michelson | 30/82 |
| 3,871,073 | A | * | 3/1975 | Nissen et al. | 30/50 |
| 3,909,939 | A | * | 10/1975 | Dootson | 30/34.2 |
| 4,063,354 | A | * | 12/1977 | Oldroyd et al. | 30/47 |
| 4,069,580 | A | | 1/1978 | Cartwright et al. | |
| 4,146,958 | A | * | 4/1979 | Chen et al. | 30/47 |
| RE30,913 | E | * | 4/1982 | Cartwright et al. | 30/47 |
| 4,443,939 | A | * | 4/1984 | Motta et al. | 30/83 |
| 4,516,320 | A | * | 5/1985 | Peleckis | 30/50 |
| 4,914,817 | A | * | 4/1990 | Galligan et al. | 30/77 |
| 5,003,694 | A | * | 4/1991 | Chen | 30/50 |
| 5,412,872 | A | * | 5/1995 | Iderosa | 30/50 |
| 5,475,923 | A | * | 12/1995 | Ferraro | 30/81 |
| 5,666,729 | A | * | 9/1997 | Ferraro | 30/50 |
| 5,933,960 | A | * | 8/1999 | Avidor | 30/50 |
| 5,953,819 | A | * | 9/1999 | Simms et al. | 30/77 |
| 6,035,535 | A | * | 3/2000 | Dischler | 30/50 |

(Continued)

FOREIGN PATENT DOCUMENTS

WO WO 9624469 A1 * 8/1996

(Continued)

OTHER PUBLICATIONS

PCT International Search Report with Written Opinion in corresponding Int'l appln. PCT/US2010/055758 dated Feb. 9, 2011.

*Primary Examiner* — Jason Daniel Prone
(74) *Attorney, Agent, or Firm* — John M. Lipchitz; Kevin C. Johnson; Steven W. Miller

(57) ABSTRACT

A shaving blade assembly having a blade unit with at least one blade and a guard bar positioned in front of the blade. A cantilever guard is positioned in front of the blade unit defining a gap between the guard bar and the cantilever guard. The cantilever guard has a plurality of spaced apart fingers extending transverse to the blade. The fingers have a wedge shaped cross section in a direction transverse to the blades and are movable relative to the guard bar between a first position and a second position during a shaving stroke.

13 Claims, 6 Drawing Sheets

U.S. PATENT DOCUMENTS

| | | | | |
|---|---|---|---|---|
| 6,161,287 | A * | 12/2000 | Swanson et al. | 30/50 |
| 6,176,014 | B1 * | 1/2001 | Garraway | 30/50 |
| 6,243,951 | B1 * | 6/2001 | Oldroyd | 30/77 |
| 7,111,401 | B2 | 9/2006 | Richard | |
| D631,198 | S * | 1/2011 | Adams et al. | D28/47 |
| 8,037,609 | B2 * | 10/2011 | Nicoll | 30/59 |
| 8,061,039 | B2 * | 11/2011 | Kwiecien et al. | 30/50 |
| D653,395 | S * | 1/2012 | Adams et al. | D28/47 |
| 2002/0000040 | A1 * | 1/2002 | Gilder | 30/77 |
| 2004/0078979 | A1 * | 4/2004 | Gilder | 30/82 |
| 2005/0172495 | A1 * | 8/2005 | Pennella | 30/79 |
| 2006/0236546 | A1 * | 10/2006 | Johnson et al. | 30/50 |
| 2006/0277770 | A1 * | 12/2006 | Coffin et al. | 30/50 |
| 2007/0180700 | A9 * | 8/2007 | Sandor et al. | 30/41 |
| 2008/0256800 | A1 * | 10/2008 | Nicoll | 30/50 |
| 2010/0101092 | A1 * | 4/2010 | Wain | 30/50 |
| 2010/0293789 | A1 * | 11/2010 | Kwiecien et al. | 30/50 |
| 2010/0299928 | A1 * | 12/2010 | Clarke et al. | 30/77 |
| 2011/0094108 | A1 * | 4/2011 | Wain | 30/77 |
| 2011/0162208 | A1 * | 7/2011 | Wain | 30/50 |
| 2011/0162209 | A1 * | 7/2011 | Wain | 30/50 |
| 2011/0308089 | A1 * | 12/2011 | Bridges | 30/77 |
| 2011/0314678 | A1 * | 12/2011 | Peterson | 30/77 |
| 2012/0030947 | A1 * | 2/2012 | Walker et al. | 30/50 |

FOREIGN PATENT DOCUMENTS

| | | |
|---|---|---|
| WO | WO 2004/069496 | 8/2004 |
| WO | WO 2007/015220 A1 | 2/2007 |

* cited by examiner

CANTILEVER COMB GUARD

FIELD OF THE INVENTION

The present invention relates to shaving blade assemblies, and more particularly, to shaving blade assemblies having a cantilever comb guard for facilitating the lifting, orientation and passage of hair to a blade for efficient and effective shaving.

BACKGROUND OF THE INVENTION

In general, a cartridge or blade unit of a safety razor has at least one blade with a cutting edge which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The guard may be generally rigid, for example formed integrally with a frame or platform structure which provides a support for the blades.

Guards are present on many shaving razors and are intended to stretch the skin; however, these guards also have a propensity to press hair against the skin. The interaction of these guards with hair is analogous to rolling a weighted drum over grass just prior to cutting the grass with the blade of a lawn mower. The grass, similar to hair on the skin, cannot be cut effectively and efficiently if it is not oriented generally perpendicular to the blade.

Standard shaving razor guards are able to cut short hairs rather effectively because short hairs are generally stiff and oriented generally perpendicular to the blade. Hair growth may vary depending on the individual, as well as the area of the body being shaved. Typically short hairs are characterized as growth of approximately twenty-four hours. As hair grows longer it has a tendency to bend over and lay flat against the surface of the skin in an orientation that is more parallel to the surface of the skin. Standard shaving razors are less effective for cutting longer hairs because the blade (or blades) has a tendency to skive or cut the hair at an angle. The blade does not consistently cut the longer hairs close to the skin surface because of the general parallel orientation of the hair. Some hairs may lay flat such that the blade of the razor passes over the hairs without cutting them. The user often has to shave the same area repeatedly to cut hairs that were either uncut or not cut close enough to the skin surface, resulting in increased skin irritation.

SUMMARY OF THE INVENTION

In one aspect, the invention features, in general, a shaving blade assembly having a blade unit with at least one blade and a guard bar positioned in front of the blade. A cantilever guard is positioned in front of the blade unit and defines a gap between the guard bar and the cantilever guard. The cantilever guard has a plurality of spaced apart fingers extending transverse to the blade. The fingers have a wedge shaped cross section in a direction transverse to the blades and are movable relative to the guard bar between a first position and a second position during a shaving stroke.

In another aspect, the invention features, in general, a shaving blade assembly having a blade unit dimensioned to receive at least one blade and a cantilever guard positioned in front of the blade unit. The cantilever guard has a plurality of spaced, apart wedge shaped fingers each with a fixed end joined to the blade unit and a free end. The fingers taper from a greater thickness at the fixed end to a lesser thickness at the free end to facilitate movement of the fingers between a first position and a second position during a shaving stroke.

If, desired, particular embodiments may optionally include a slotted guard bar positioned between the blade and the cantilever guard. Particular embodiments may also optionally include a gliding member that circumscribes the blade unit and the cantilever guard.

DETAILED DESCRIPTION OF THE INVENTION

Figure 1:
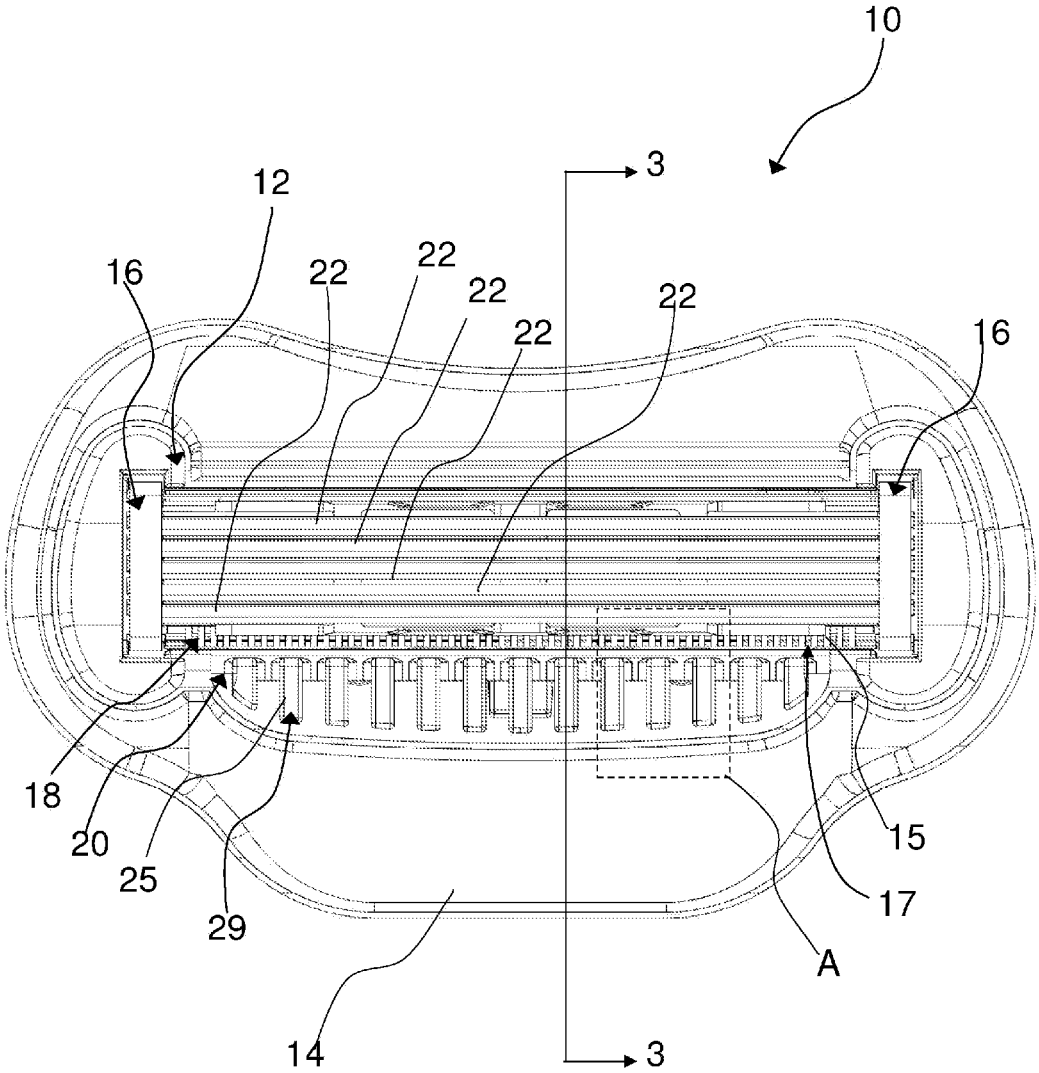
FIG. 1 is a top view of an embodiment of a shaving blade assembly of the present invention.

Referring to FIG. 1, one embodiment of the present invention is shown illustrating a shaving blade assembly 10 that includes a blade unit 12, a gliding member 14, and a cantilever guard 20. One or more blades 22 may be mounted to the blade unit 12. The blades 22 may be secured to the blade unit 12 with a pair of clips 16; however, other assembly/securing methods known to those skilled in the art may be used including, but not limited to, wire wrapping, cold forming, hot staking, insert molding, and adhesives. Although five blades 22 are shown, it is understood that the blade unit 12 may have more or fewer blades 22. In certain embodiments, the blade unit 12 may include a guard bar 18 positioned in front of the blades 22. The guard bar 18 may be a solid member or may have a plurality of projections 15 that define a series of slots 17 that are transverse to the blades 22. The guard bar 18, as illustrated in FIG. 1, has a generally rectangular cross section, but numerous cross sectional shapes are possible, such as circles, squares, triangles, ovals, or any combination thereof.

The blade unit 12 may be injection molded from a semi-rigid polymeric material, for example, Noryl™ (a blend of polyphenylene oxide (PPO) and polystyrene developed by General Electric Plastics, now SABIC Innovative Plastics). The blade unit 12 may be molded from other semi-rigid polymeric materials having a Shore A hardness of about 50, 60, or 70 to about 90, 110, or 120, such as high impact polystyrene, polypropylene, acrylonitrile butadiene styrene, or any combination thereof. A semi-rigid material may allow the blade unit 12 to maintain a consistent geometry during shaving. The blade unit 12 may be of sufficient stiffness such that it does not bend or flex under normal shaving conditions, which may adversely influence the shave geometry of the shaving blade assembly 10.

The gliding member 14 may be positioned behind the blade unit 12 and in front of the cantilever guard 20. In certain embodiments, the gliding member 14 may be a ring that circumscribes the blade unit 12, the guard bar 18, and the cantilever guard 20 such that lubrication is provided both in front of and behind the blades 22 during shaving for enhanced comfort. In other embodiments, the gliding member 14 may be positioned only behind the blades 22, but not in front of the blades 22. The gliding member 14 may have a smooth surface and may be provide lubrication to the skin by delivering a shaving aid in front of and/or behind the blade unit 12. In certain embodiments, the gliding member 14 may include a shaving aid such as a soap, for example, a poured or extruded soap. Soap-based compositions may be modified to increase hardness, wear resistance, lubricity and/or skin moisturizing and conditioning properties of the gliding member 14. Other materials may be used for the gliding member 14, such as a material comprising a mixture of a hydrophobic material and a water leachable hydrophilic polymeric material, as is known in the art and described in U.S. Pat. Nos. 5,113,585 and 5,454,164. The gliding member 14 may have sufficient wear resistance such that the gliding member 14 lasts for the intended life of the shaving blade assembly 10 (e.g., the blades become too dull). In other embodiments, the gliding member 14 may be injection molded from semi-rigid polymeric materials that do not wear under normal shaving conditions, such as, Noryl™ (a blend of polyphenylene oxide (PPO) and polystyrene developed by General Electric Plastics, now SABIC Innovative Plastics). The gliding member 14 may be molded from other semi-rigid polymeric materials having a Shore A hardness of about 50, 60, or 70 to about 90, 110, or 120, such as, but not limited to high impact polystyrene, polypropylene, acrylonitrile butadiene styrene (ABS), polytetrafluoroethylene (PTFE), high density polyethylene (HPDE), acetal, nylon or any combination thereof. The polymeric material may also be filled with materials such as silicone, molidium disulfide, or other lubricating agents known to those skilled in the art for reducing friction against the surface of the skin.

The cantilever guard 20 may extend parallel to the blades 22 and may be positioned in front of the guard bar 18 and behind the gliding member 14. The cantilever guard 20 may be used alone or in combination with the guard bar 18 (e.g., the cantilever guard 20 may be positioned directly in front of the guard bar 18 or directly in front of the blades 22). The cantilever guard 20 may also be used alone or in combination with the gliding member 14. The cantilever guard 20 may have a plurality of spaced apart fingers 25 that extend transverse to the blades 22. The fingers 25 may facilitate the orientation or lifting of hair in an upward direction away from the skin surface. The fingers 25 may also facilitate the passing of hair to the blades 22 in a more upright position, which may provide more efficient and accurate cutting of hairs during a shaving stroke. In certain embodiments, the fingers 25 may be configured for lifting and guiding longer hairs to the guard bar 18, which may further align and pass the hairs to the blades 22 for a closer and more comfortable shave. As will be explained in greater detail below, the fingers 25 may deflect transversely relative to the blades 22 to follow the contours of the skin and facilitate the lifting of hair from the surface of the skin. The fingers 25 may have a top surface 29 that is flat for facilitating the engagement and lifting of hair. The fingers 25 may extend along the entire length of the cantilever guard 20, or they may extend along only certain sections of the cantilever guard 20, such as in the middle or at the ends. In certain embodiments, the plurality of fingers 25 may extend less than a length of the blades 22. For example, the plurality of fingers 25 may extend about 50%, 55%, or 60% to about 75%, 85%, or 95% of the length of the blades 22.

The cantilever guard 20 (and/or the fingers 25) may be molded from a resilient material to facilitate flexing of the fingers 25 in a direction transverse to the blades 22. The resilient material may also improve tactile sensation against the skin and provide improved stretching of the skin compared to more rigid materials. The material properties of the cantilever guard 20 may facilitate the fingers 25 to deflect under normal shaving forces and lift hairs that may lie flat against the surface of the skin. The cantilever guard 20 and or the fingers 25 may be manufactured from a softer material than blade unit 12. For example, the cantilever guard 20 and/or the fingers 25 may have a Shore A hardness of about 20, 30, or 40 to about 50, 60, or 70. The cantilever guard 20 and/or the fingers 25 may be molded from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs, polyester TPEs, polyamide TPEs, polyurethane TPEs, polyolefin based TPEs, and blends of any of these TPEs (e.g., polyester/SEBS blend). In certain embodiments, the cantilever guard 20 may comprise the thermoplastic elastomer compound Dynaflex® G6730 from GLS Corp. (a PolyOne business). The cantilever guard 20 and/or the fingers 25 may comprise other resilient materials that provide sufficient flexibility for the flexing of the fingers 25. Such materials may have an elongation at break of about 100%, 300%, or 500% to about 700%, 800%, or 1000% (ASTM D412-Die C, 2 hrs, 23° C.). If the elongation of the material of the fingers 25 is too great, the fingers 25 may not provide sufficient resistance to lift the hair from the surface of the skin, or the fingers 25 may roll or flip back on themselves. A material having a greater elongation (or lower Shore A hardness) may enhance skin stretching and provide a more pleasant tactile feel against the skin of the user during shaving, as well as improve the ability of the fingers 25 to lift hair. A material having a greater elongation (or lower Shore A hardness) may also be chosen to aid in masking the unpleasant feel of the harder material of the blade unit 12 and blades 22 against the user's skin during shaving. Alternatively, the cantilever guard 20 and/or the fingers 25 may comprise a polymeric material having a Shore A hardness of about 70 to about 120. In certain embodiments, the cantilever guard 20 and/or the fingers 25 may be made of stiffer (e.g., lower elongation) or harder materials that include a living hinge to aid in the deflection of the fingers 25.

Figure 2:
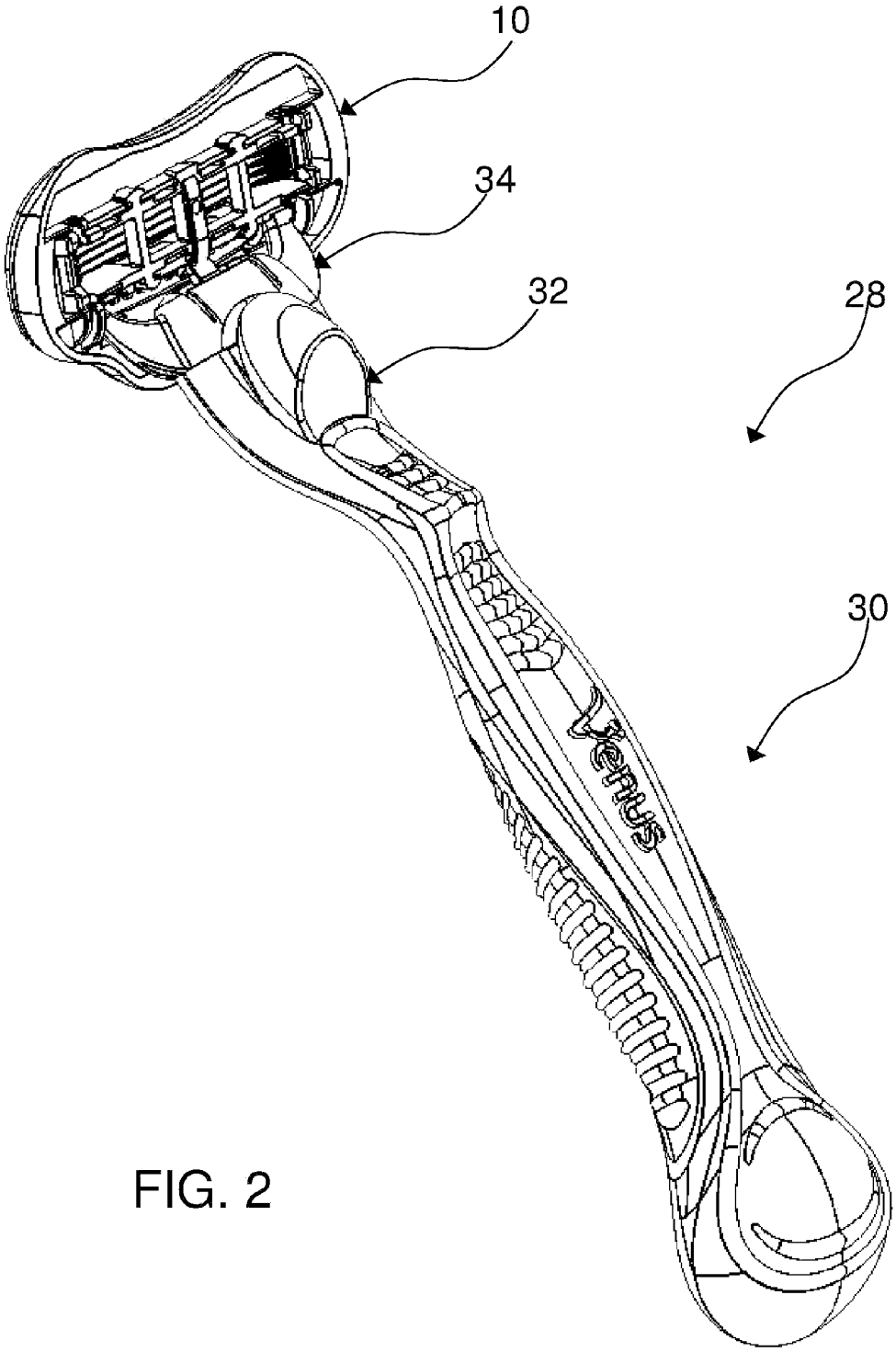
FIG. 2 is a perspective view of the shaving blade assembly of FIG. 1 attached to a handle.

Referring to FIG. 2, in certain embodiments, the shaving blade assembly 10 may be part of a shaving system 28 in which the shaving blade assembly 10 is associated with a handle 30. The shaving blade assembly 10 may be permanently mounted to the handle 30 or may be mounted in a detached manner and replaced as needed. The shaving blade assembly 10 may be fixedly or pivotably mounted to the handle 30 to follow the contours of the skin during shaving. The shaving blade assembly 10 may also include an interconnect member 34 to which the shaving blade assembly 10 is pivotably mounted about a pivot axis. A release button 32 may be provided on the handle 30 to facilitate the removal of the shaving blade assembly 10 from the handle 30.

Figure 3:
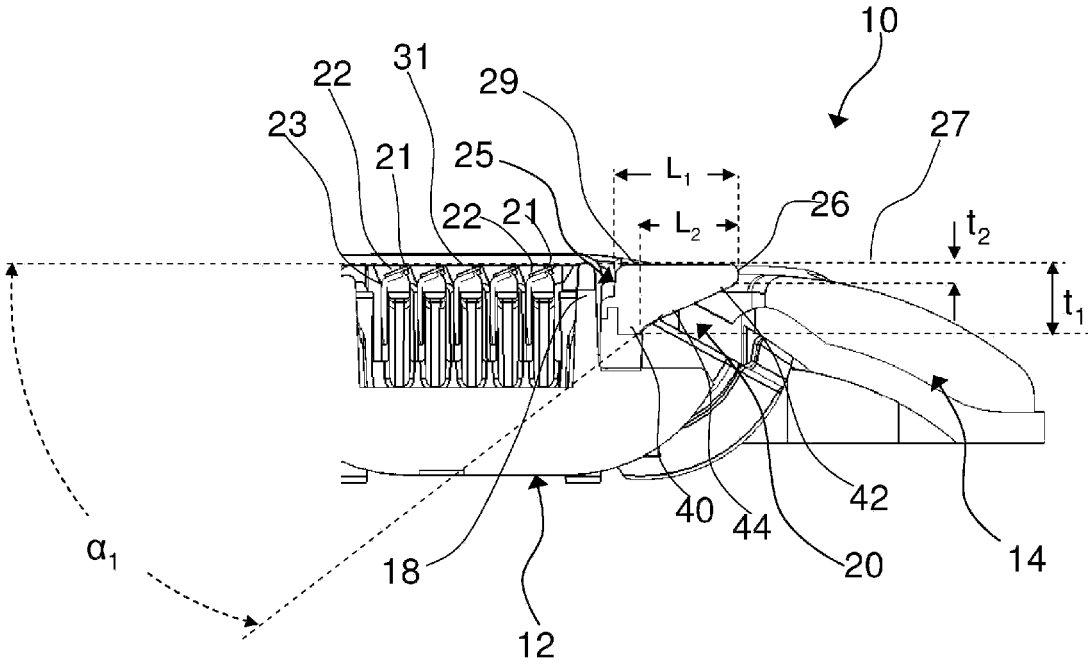
FIG. 3 is partial cross section view of the shaving blade assembly, taken generally along the line 3-3 of FIG. 1.

Referring to FIG. 3, a partial cross section view of the shaving blade assembly 10 is shown, taken generally along the line 3-3 of FIG. 1. The cross section of FIG. 3 is taken in a direction transverse to the blades 22. The blades 22 may have a cutting edge 21 that defines a blade plane 31 that is tangent to two or more of the cutting edges 21. For example, the blade 22 closest to the guard bar 18 and the blade 22 furthest from the guard bar 18 may define and be tangent to the blade plane. Additional blades 22 may be positioned above, below, or on the blade plane 31. Each of the blades 22 may be mounted to a blade support 23. The blades 22 and blade supports 23 may be spaced apart from the guard bar 18 and the fingers 25. The fingers 25 may deflect independently of the blade unit 12 (e.g., relative to the guard bar 18, blade supports 23, and/or blades 22) to facilitate orientation of hair in an upward direction away from the skin surface to allow the blades 22 to cut the hair more evenly and closer to the surface of the skin.

The fingers 25 may have an overall length $L_1$ of about 1.0 mm, 2.0 mm, or 3.0 mm to about 3.5 mm, 4.0 mm, or 5.0 mm. The fingers 25 may each have a fixed end 40 that is joined to the blade unit 12 and a free end 42 that is spaced apart from the gliding member 14. In certain embodiments, the fixed end 40 may be joined to the guard bar 18 and the blade unit 12 may be separable from the shaving blade assembly 10. The cantilever guard 20 may be joined to the blade unit 12 and/or the guard bar by insert molding or co-injection molding. Other mechanical or chemical assembly/securing methods known to those skilled in the art may also be used to join the blade unit to the cantilever guard 20, such as adhesives, wire wrapping, or mechanical fasteners. The fixed end 40 may be supported by the blade unit 12 and the free end 42 may be unsupported (e.g., by either the blade unit 12 or the gliding member 14) to facilitate flexing of the fingers 25 under normal shaving forces. A significant portion of the fingers 25 may be unsupported, for example, the unsupported length of the fingers 25 may be about 50%, 60%, or 70% to about 75%, 85%, or 95% of an overall length of the fingers 25. The fingers 25 may have an unsupported length $L_2$ of about 0.50 mm, 1.0 mm, or 1.50 mm to about 2.5 mm, 3.5 mm, or 4.5 mm.

The free end 42 may have a tip 26 with radius of about 0.1 mm, 0.15 mm, or 0.2 mm to about 0.3 mm, 0.4 mm or 0.5 mm. The tip 26 may be defined as the most forward portion of the fingers 25 (e.g., closest to the gliding member 14). The tip 26 may be positioned at or below a plane 27 of the top surface 29 of the fingers 25. In certain embodiments, the top surface 29 of the fingers may extend along the blade plane 31, such that the radius of the tip 26 is also positioned below the blade plane 31. In other embodiments, the tip 26 may be positioned at or above the blade plane 31. The top surface 29 may be level or may decline from the fixed end 40 to the free end 42 to improve ability of the fingers 25 to engage and lift hair.

In certain embodiments, the fingers 25 may have a wedge shaped cross section (e.g., a triangular cross sectional shape) that is transverse to the blades 21 such that the fingers 25 taper from a greater thickness "$t_1$" at the fixed end 40 to a lesser thickness "$t_2$" at the free end 42. In certain embodiments, $t_2$ may be about 0.25 mm, 0.5 mm, or 0.75 mm to about 1.75 mm, 2.0 mm, or 2.25 mm and $t_1$ may be about 1.0 mm, 1.5 mm, or 1.75 mm to about 2.0 mm, 3.0 mm, or 4.0 mm. The wedge shape geometry may facilitate the flexing of the fingers 25 and the lifting of hair from the surface of the skin during shaving. The fingers 25 may have a taper angle $\alpha_1$ that is defined by the top surface 29 and a bottom surface 44 of the fingers 25. The taper angle $\alpha_1$ may be about 10 degrees, 15 degrees or 20 degrees to about 30 degrees, 40 degrees, or 50 degrees to facilitate and control the deflection of the fingers 25.

Figure 4:
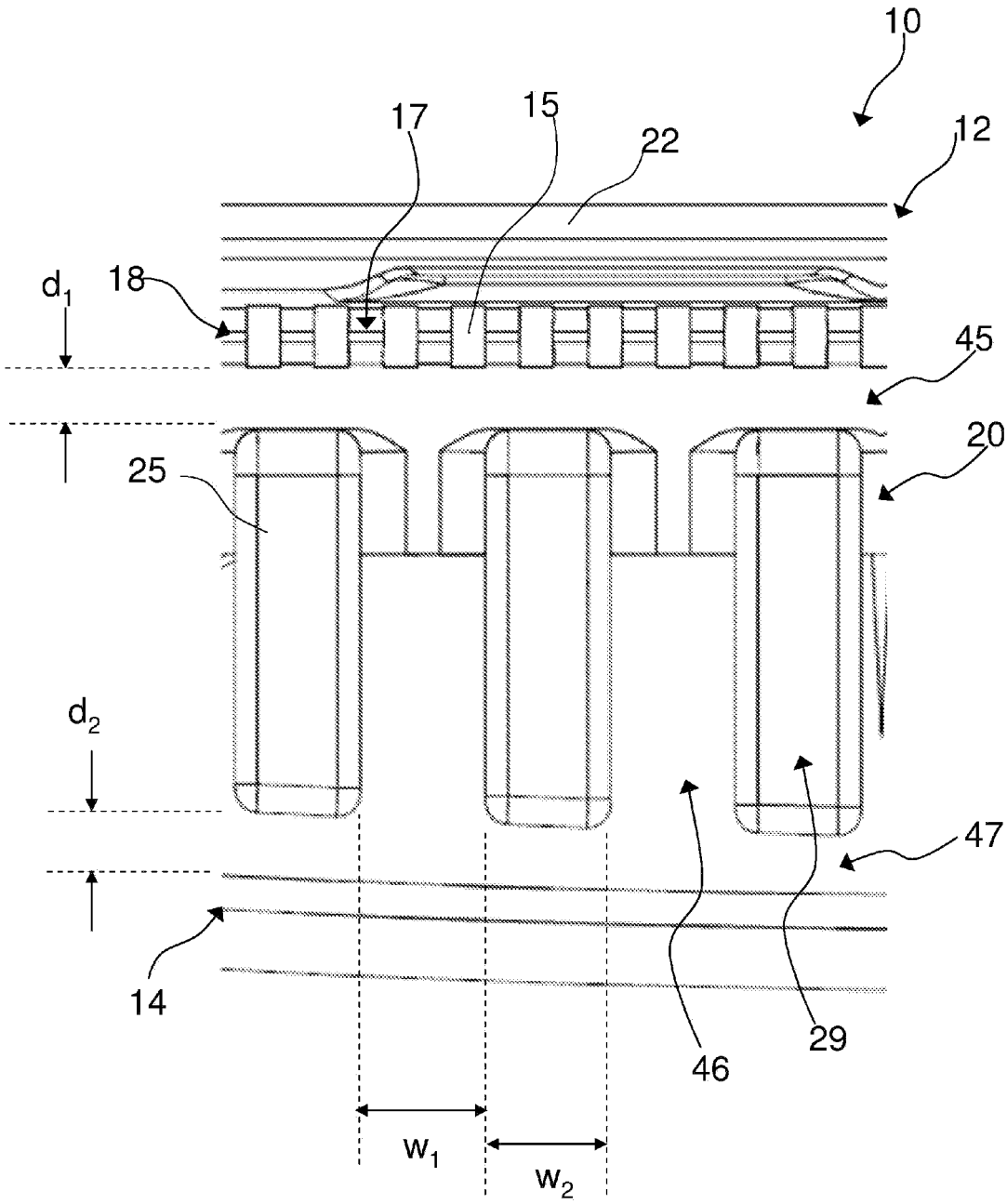
FIG. 4 is a partial top view of the shaving blade assembly of FIG. 1.

Referring to FIG. 4, a partial top plan view of the shaving blade assembly 10 is shown. In certain embodiments, the cantilever guard 20 and/or the fingers 25 may be spaced apart from the projections 15 and/or the guard bar 18 to define a gap 45 having a distance $d_1$ of about 0.5 mm, 0.75 mm, or 1.0 mm to about 1.5 mm, 2.0 mm, or 2.5 mm. The spacing between the guard bar 18 (and/or the projections 15) and the cantilever guard 20 (and/or fingers 25) may facilitate the release of any hair that may become trapped under the fingers 25 during shaving. In certain embodiments, the projections 15 of the guard bar 18 may be offset from the fingers 25 of the cantilever guard 20. The projections 15 may align any hairs missed by the fingers 25. The fingers 25 may be spaced apart to define an open slot 46 having a width $w_1$ of about 0.5 mm, 1.0 mm, or 1.5 mm to about 2.0 mm, 3.0 mm, or 4.0 mm to facilitate rinsing of the shaving blade assembly 10. The open slot 46 may also provide for the unobstructed passage of hair to the guard bar 18 and/or to the blades 22. The fingers 25 may have a width $w_2$ of about 0.5 mm, 1.0 mm or 1.5 mm to about 2.0 mm, 3.0 mm, or 4.0 mm. The dimensions of the fingers 25 may prevent the fingers 25 from flipping back on themselves or rolling over during shaving. If the fingers 25 roll over or flip back during shaving, then the hair would not be properly lifted and the fingers 25 would feel uncomfortable against the surface of the skin during shaving. The gliding member 14 may be positioned in front of the cantilever guard 20 such that the fingers 25 are spaced apart from the gliding member 14 to define a gap 47 having a distance $d_2$ of about 0.5 mm, 1.0 mm or 2.0 mm to about 3.0 mm, 4.0 mm, or 5.0 mm. The gap 47 may allow any hairs that are trapped under the gliding member 14 to release and be engaged by the cantilever guard 20. In other embodiments, the gliding member 14 may be located in back of the blades 22 and/or laterally of the blades 22 and/or cantilever guard 20 (e.g., there may be no other component in front of the cantilever guard 20).

During a shaving stroke, the gliding member 14 may apply shaving aid to the skin in front of the cantilever guard 20. Alternatively, the gliding member 14 may not deposit a shaving aid on the surface of the skin. As the hair passes from the gliding member 14 to the cantilever guard 20, the gap 47 may expose the hair to the fingers 25. The fingers 25 of the cantilever guard 20 engage the hair and deflect in a direction transverse to the blades 22. The fingers 25 may deflect independently of each other to facilitate the lifting of hairs as the shaving blade assembly 10 follows the contours of the skin during shaving. The fingers 25 may orient the hair in an upward direction away from the skin surface and pass it to the guard bar 18 (or directly to the blades 22). As the shaving blade assembly 10 glides across the surface of the skin, the top surface 29 of the fingers 25 may stretch the skin to reduce skin bulges (which often leads to nicks and cuts). Some hairs may not engage the fingers 25, but may pass unobstructed through the slots 46 and to the guard bar 18. The slots 17 and projections 15 may align the hair further for cutting by the blade 22. The gap 45 between the guard bar 18 and the cantilever guard 20 may allow the hairs to release or flick up from the surface of the skin just before the hair is cut by the blade 22.

Figure 5:
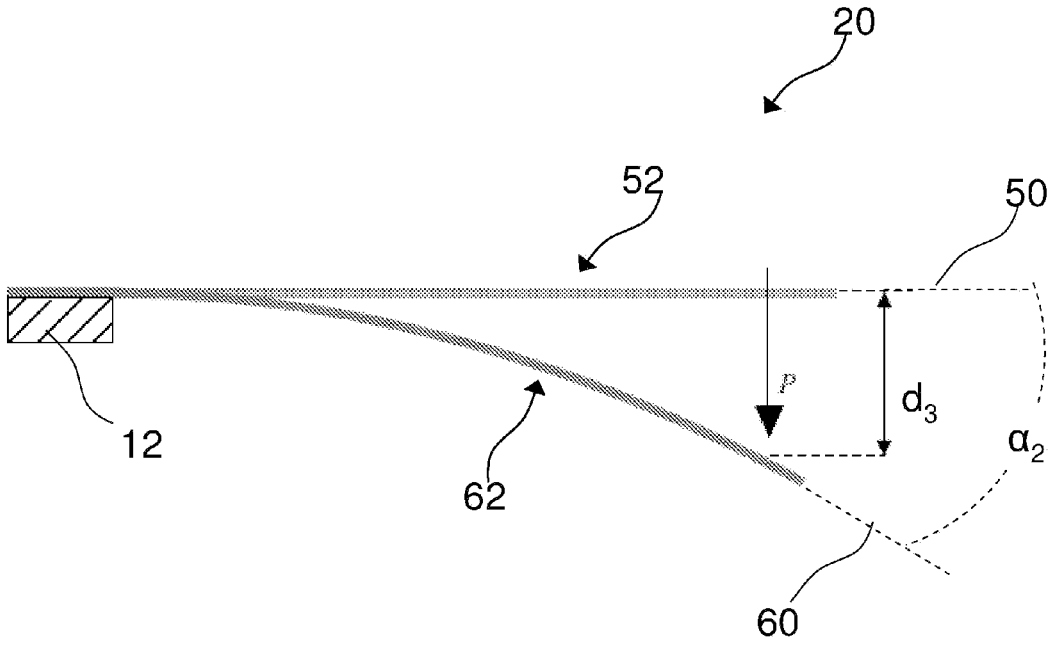
FIG. 5 is a schematic diagram of a finger of a cantilever guard which may be incorporated into the shaving blade assembly of FIG. 1.

Referring to FIG. 5, a schematic diagram representing the fingers 25 of the cantilever guard 20 is shown. The fingers 25 may be movable between a first position 52 and a second position 62. In the first position 52, the plurality of spaced apart fingers 25 may have a longitudinal axis 50 that extends transverse to the blade unit 12. The fingers 25 may be unloaded in the first position 52 such that the fingers 25 are not deflected relative to the blade unit 20. During shaving the force of shaving blade assembly 10 against the surface of the skin may apply a load P that causes the fingers 25 to deflect resulting in the second position 62. In the second position 62 (e.g., during shaving), the fingers 25 may have a longitudinal axis 60 that is deflected at an angle relative to the longitudinal axis 50 (e.g., below the longitudinal axis 50). An angle of deflection $\alpha_2$ of the longitudinal axis 60 of the fingers 25 relative to the longitudinal axis 50 (and/or the blade unit 12) may be about 10 degrees, 15 degrees, or 20 degrees to about 25 degrees, 30 degrees, or 40 degrees. The applied load may cause the fingers 25 to deflect a distance $d_3$ of about 0.1 mm, 0.5 mm, or 1.0 mm to about 2.0 mm, 3.0 mm, or 4.0 mm. The fingers 25 may engage the hair and lift the hair up as the applied load changes (e.g., as the load is removed or decreased). The force needed for the applied load to deflect the fingers 25 by the distance $d_3$ may vary depending on where along the length of the finger 25, the load P applied, as well as, the geometry and dimensions of the fingers 25. The width $w_2$, the unsupported length $L_2$, and the thickness $t_2$ of the fingers 25 may all be varied to increase or decrease the force required to deflect the fingers 25. For example, one particular embodiment of the cantilever guard 20 which may provide sufficient flexibility may include fingers 25 molded from an elastomer having a Shore A hardness of about 50 to 70 and may have a triangular shaped cross section with an overall length $L_1$ of about 3.6 mm, an unsupported length $L_2$ of about 2.8 mm, a taper angle of about 25 degrees, a width $w_2$ of about 1.0 mm, a thickness $t_1$ of about 3.0 mm and a thickness $t_2$ of about 0.25 mm.

Figure 6A:
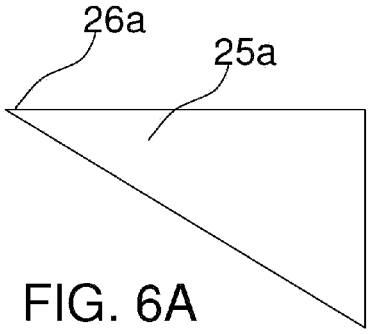
FIGS. 6A-6F are cross section views of various embodiments of a finger which may be incorporated into the cantilever guard of the shaving blade assembly of FIG. 1.
Figure 6B:
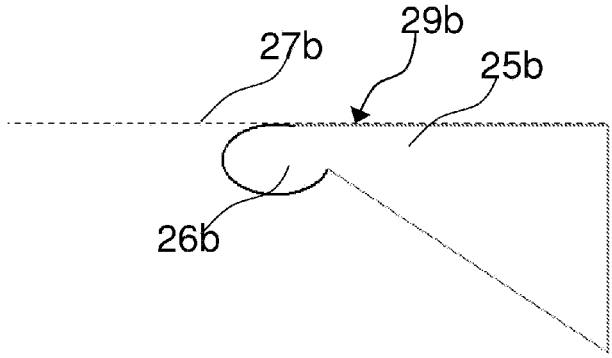
Figure 6C:
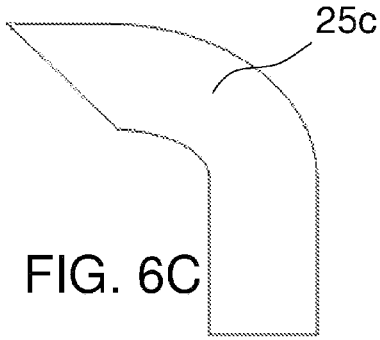
Figure 6D:
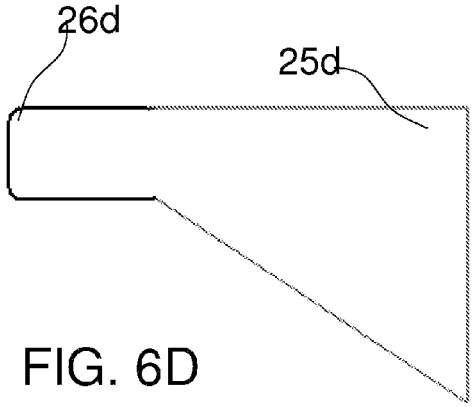
Figure 6E:
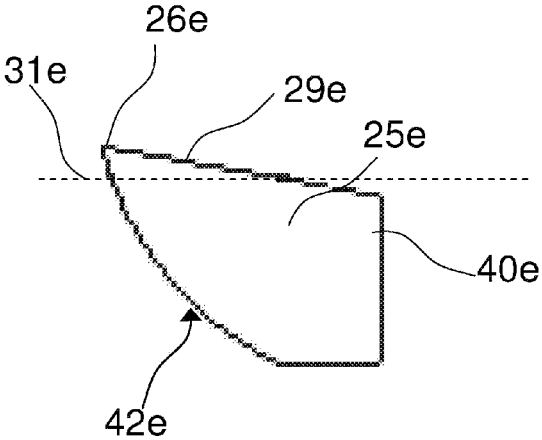
Figure 6F:
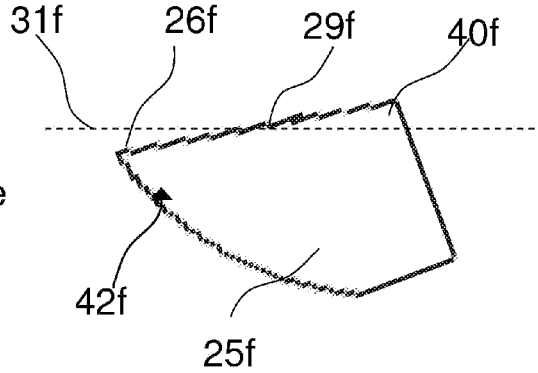

Referring to FIGS. 6A-6F, the fingers 25 may have several different cross sectional geometries and tip configurations for facilitating the lifting of hairs from the skin and improving tactile feel during shaving. For example, FIG. 6A illustrates a finger 25*a* having a tip 26*a* that comes to a point and FIG. 6B illustrates a finger 25*b* having a bulbous tip 26*b*. The bulbous tip 26*b* may be positioned below a plane 27*b* that extends along a top surface 29*b* of the finger 25*b*. The finger 25*a* may be more efficient at lifting hairs and finger 25*b* may provide the user with a more pleasant tactile feel during shaving while still providing the benefit of lifting hairs. FIG. 6C illustrates a finger 25*c* that is similar to finger 25*a*, except finger 25*c* may have a "J" or "L" shaped cross section. The "J" or "L" shaped cross section of fingers 25*c* may facilitate greater deflection of the fingers 25 compared to finger 25*a*. FIG. 6D illustrates a wedge shaped finger 25*d* having a blunt tip 26*d*. In all of the embodiments discussed, the top surface 29 may be above, below, or at the blade plane 31. In certain embodiments, a finger 25*e* may have an angled top surface 29*e* (e.g., declines from a tip 26*e* to a fixed end 40*e*). The finger 25*e* may have a portion that is above a blade plane 31*e* (e.g., the tip 26*e* and/or the free end 42*e*) and a portion below the blade plane 31*e* (e.g., a fix end 40*e*). Alternatively, a finger 25*f* may have an angled top surface 29*f* that inclines from a tip 26*f* to a fixed end 40*f*. The tip 26*f* and the free end 42*f* may be below a blade plane 31*f* and the fixed end 40*f* may be above the blade plane 31*f*.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving blade assembly comprising:

at least one blade having a cutting edge;

a blade unit dimensioned to receive the at least one blade; and a cantilever guard positioned in front of the blade unit, the cantilever guard having a plurality of spaced apart wedge shaped fingers having a fixed end joined to the blade unit and a free end, wherein the fingers taper in a direction transverse to the cutting edge of the at least one blade from a greater thickness at the fixed end to a lesser thickness at the free end to facilitate movement of the fingers between a first position and a second position during a shaving stroke.

2. The shaving blade assembly of claim 1 wherein the fingers have a flat top surface and an angled bottom surface.

3. The shaving blade assembly of claim 2 wherein the top surface and the bottom surface define a taper angle of about 10 degrees to about 50 degrees.

4. The shaving blade assembly of claim 2 wherein the fingers comprise a resilient material having a Shore A hardness of about 20 to about 70.

5. The shaving blade assembly of claim 2 further comprising a gliding member positioned in front of the cantilever guard defining a gap between the cantilever guard and the gliding member that extends along a length of the cantilever guard.

6. The shaving blade assembly of claim 5 wherein the gliding member circumscribes the blade unit and delivers a shaving aid in front of and behind the blade unit.

7. The shaving blade assembly of claim 1 wherein the at least one blade with the cutting edge is a plurality of blades each having a cutting edge.

8. The shaving blade assembly of claim 7 further comprising a guard bar p9ositioned between the blades and the cantilever guard, the guard bar having a plurality of open slots that extend transverse to the blades.

9. The shaving blade assembly of claim 8 further comprising a handle mounted to the blade unit.

10. The shaving blade assembly of claim 8 wherein the guard bar is spaced apart from the cantilever guard by 0.5 mm to 2.5 mm

11. The shaving blade assembly of claim 7 further comprising a blade plane that is tangent to the cutting edges.

12. The shaving blade assembly of claim 11 wherein the fingers have a tip that is positioned below the blade plane.

13. The shaving blade assembly of claim 12 wherein each of the tips has a radius of about 0.15 mm to about 0.5 mm.

* * * * *

UNITED STATES PATENT AND TRADEMARK OFFICE

CERTIFICATE OF CORRECTION

PATENT NO. : 8,209,869 B2
APPLICATION NO. : 12/614600
DATED : July 3, 2012
INVENTOR(S) : Terence Gordon Royle It is certified that error appears in the above-identified patent and that said Letters Patent is hereby corrected as shown below:

Column 8

Line 49, delete "p9ositioned" and insert -- positioned --

Signed and Sealed this
Twenty-first Day of August, 2012

David J. Kappos

David J. Kappos
*Director of the United States Patent and Trademark Office*